United States Patent [19]

Reimann

[11] Patent Number: 4,526,639

[45] Date of Patent: Jul. 2, 1985

[54] APPARATUS AND METHOD FOR FORMING AND STACKING PLASTIC BAGS

[75] Inventor: George J. Reimann, Pittsford, N.Y.

[73] Assignee: Mobil Oil Corporation, New York, N.Y.

[21] Appl. No.: 404,175

[22] Filed: Aug. 2, 1982

[51] Int. Cl.[3] ..... B31B 1/86

[52] U.S. Cl. ..... 156/182; 156/251; 156/515; 156/558; 156/163; 493/194; 493/203; 493/204

[58] Field of Search ..... 156/510, 515, 556, 558, 156/563, 182; 493/194–204

[56] References Cited

U.S. PATENT DOCUMENTS

| | | | |
|---|---|---|---|
| 3,607,534 | 9/1971 | Gutman | 156/269 |
| 4,198,260 | 4/1980 | Mundus et al. | 156/515 |
| 4,268,346 | 5/1981 | Achelpohl | 156/515 X |
| 4,378,268 | 3/1983 | Lehmacher | 156/563 X |

FOREIGN PATENT DOCUMENTS

| | | |
|---|---|---|
| 1809659 | 7/1970 | Fed. Rep. of Germany . |
| 2326524 | 12/1975 | Fed. Rep. of Germany . |
| 2554395 | 8/1978 | Fed. Rep. of Germany . |
| 2924106 | 12/1980 | Fed. Rep. of Germany . |
| 2071063 | 9/1981 | United Kingdom . |

*Primary Examiner*—David Simmons
*Attorney, Agent, or Firm*—Alexander J. McKillop; Michael G. Gilman; Charles J. Speciale

[57] ABSTRACT

An apparatus and method of forming individual sealed plastic bags from a continuous web of a layflat tubular film material wherein the individual plastic bags, subsequent to the formation of bag seals and the separation of the film web into individual plastic bags, are intermittently and sequentially conveyed through a cooling zone which will allow for the cooling of the bag seals. Thereafter, the bags are serially conveyed to a bag stacking arrangement incorporating a stacker foot which will position the first or bottom bag of a stack being formed on a vacuum box which retains the bag in a fixed position and with subsequent bags being superimposed on preceding deposited bags and sealed thereto through the intermediary of heated needles depending from the stacker foot which will penetrate and concurrently seal the bags together at predetermined locations. The forward portion of the bags of the stack is supported on a continuously-driven conveyor belt which, when a predetermined number of bags have been stacked, will cause the bags to be conveyed into a further storage conveyor.

20 Claims, 14 Drawing Figures

APPARATUS AND METHOD FOR FORMING AND STACKING PLASTIC BAGS

BACKGROUND OF THE INVENTION

1. Field of the Invention

The present invention relates to an apparatus and method for sequentially forming a plurality of plastic bags from a continuous layflat tubular film of plastic material and for the accurate stacking of the plastic bags.

The utilization of plastic bags as an attractive alternative to the widely employed paper bags has formed widespread application, particularly in many retailing establishments and supermarkets. Basically, plastic bags are employed because of their attractiveness and their adaptability to having carrying handles integrally formed with the bag so as to render easier to lift and carry when filled with merchandise. Moreover, plastic bags generally evidence a higher strength in comparison with paper bags, and are impervious to moisture which will frequently cause paper bags to tear so as to result in spillage and possible damage to the bagged merchandise.

Inasmuch as plastic bags are usually formed from a plastic film material which is rather thin and of a limp easily crumpled nature, it is desirable that, prior to their individual use, such bags be stored and transported in accurately assembled stacks, consisting of large numbers of such plastic bags and which will facilitate the handling thereof by shipping and retailing personnel.

Consequently, there is a demand for apparatus and methods for rapidly and efficiently manufacturing such plastic bags from plastic film, and to superimpose and seal together the plastic bags into a coherent stack for easy handling.

2. Discussion of the Prior Art

Apparatuses are presently known for the stacking of plastic bags which have been formed on intermittently operating types of bag making machines. Basically, a known method and apparatus consists in forming stacks of bags immediately in front of the seal roll of a bag former after the continuous layflat plastic film has been sealed. At that location, the bags are impaled on hot pins which seal individual bags together and retain the stacked plastic bags in position relative to each other. The completed stack is then removed by the action of a device which grips the stack at the leading end thereof and pulls it out from the stacking location. Inasmuch as the prior art methods contemplate such stacking and sealing together of the formed plastic bags immediately after the formation of the hot bag seals, there is no provision for a seal cooling section and it is difficult to maintain the hot seals of superimposed plastic bags separate before they touch each other. This will frequently cause the hot seals to adhere to each other and renders subsequent separation of individual plastic bags difficult or even impossible without damaging the bag seals, often rendering the bags useless. Furthermore, the time-consuming stack forming sequence in apparatuses of that type necessitates that during the removal of each formed stack, the operating cycle of the synchronously operating bag-forming machine must be interrupted, during which interval no bags are formed, thereby reducing the production efficiency of such apparatus.

Another method and apparatus employed in the prior art for the stacking of plastic bags which are sequentially produced from a continuous layflat tubular film of plastic material consists of in forming the hot bag seals extending transversely of the direction of the longitudinal movement of the plastic film and concurrently separating the film into individual bags each having sealed leading and trailing edges. Thereafter the bags are superimposed upon each other through the intermediary of a rotating paddle wheel which engages the surface of each sequentially fed bag and superimposes it upon precedingly formed bag. As with other types of apparatus, also in this instance, when the formed stack of bags are to be removed, there is required a time-consuming interruption in the operating cycle of the bag-forming machine. Moreover, there is no firm interconnection provided between the individual bag of the bag stack which would preclude any slipping off or displacement of other bags in the stack prior to and during removal of the individual uppermost bag in the stack.

SUMMARY OF THE INVENTION

Accordingly, in order to obviate the disadvantages and limitations encountered in the prior art, the present invention provides for an apparatus and method of forming individual sealed plastic bags from a continuous web of a layflat tubular film material wherein the individual plastic bags, subsequent to the formation of bag seals and the separation of the film web into individual plastic bags, are intermittently and sequentially conveyed through a cooling zone which will allow for the cooling of the bag seals. Thereafter, the bags are serially conveyed to a bag stacking arrangement incorporating a stacker foot which will position the first or bottom bag of a stack being formed on a vacuum box which retains the bag in a fixed position and with subsequent bags being superimposed on preceding deposited bags and sealed thereto through the intermediary of heated needles depending from the stacker foot which will penetrate and concurrently seal the bags together at predetermined locations. The forward portion of the bags of the stack is supported on a continuously-driven conveyor belt which, when a predetermined number of bags have been stacked, will cause the bags to be conveyed into a further storage conveyor.

This, in essence, will provide an apparatus and method through which, in a simple and accurate manner, plastic bags are formed in an intermittently-operating bag forming apparatus from a continuous layflat tubular plastic film, with transversely leading and trailing edge bag seals being formed while the film is concurrently separated intermediate the seals into individual plastic bags, with the hot seals being cooled in a zone including a plurality of parallel, perforated conveyor belts with narrow spaces between them which are superimposed on a vacuum box, and with a novel and unique stacking apparatus of simple design being provided which will ensure the stacking and sealing together an accurate manner of predetermined quantities of the formed plastic bags.

The primary advantages which are obtained through the utilization of the inventive apparatus and method, and which result in a simple and readily accessible, reliable and safely-operated arrangement, consists of:

1. Cooling of the hot seals formed on the plastic bags during the bag forming operation preceding the stacking operation through the intermediary of indexing perforated conveyor belts which are transported over a vacuum box to ensure that adequate cooling air circulates about the hot seals.

2. Positive control being imparted over the movement of plastic bag positioned on the perforated conveyor belts in the cooling zone until the bag is sealed onto a stack of bags.

3. Sealing of the individual plastic bags for the formation of a stack is effected in sequential order through the utilization of a stacker foot employing small diameter heated needles penetrating the stack of bags and sealing the bags to each other at the locations where they are perforated by the heated needles, with such needles requiring only small amounts of energy.

4. The apparatus affords the simple and fully automatic removal of the stack of superimposed, together sealed plastic bags from the stacking location without necessitating any delays in the bag forming cycle of the apparatus.

Accordingly, it is a primary object of the present invention to provide an apparatus for the forming and sequential stacking of a plurality of plastic bags in which the stacked bags are sealed together in an accurate arrangement.

A more specific object of the present invention is to provide an apparatus of the type described which will provide for plastic bags which are hot sealed at each end and formed from a continuous web of a layflat tubular plastic film in having the hot seals cooled prior to the bags being accurately positioned in a superimposed and interconnected relationship to form a coherent stack of bags, and to thereby avoid sticking together of the bag seals.

Still another object of the present invention is to provide an apparatus for the forming and stacking of a plurality of plastic bags of the type described hereinabove in which, subsequent to the formation of hot seals on individual plastic bags formed from a continuous web of a layflat tubular plastic film, the plastic bags are conveyed through a cooling zone provided for by perforated conveyor belts traveling over a vacuum box, and wherein the plastic bags are thereafter superimposed in an accurate position and formed into an adherent stack through the action of a stacker foot incorporation heated needles penetrating and sealing the stacked bags to each other.

Yet another object of the present invention resides in that provision of a method of forming an accurately positioned and sealed together stack of individual plastic bags formed from a continuous web of a layflat tubular or plastic film, in which the stacking is effectuated in an automatic manner, and the removal of the formed bag stack will not necessitate the interruption of the bag-forming and stacking cycles.

BRIEF DESCRIPTION OF THE DRAWINGS

These and other objects of the invention may now be more clearly ascertained from the following detailed description of a preferred embodiment of an apparatus for the forming and stacking of a plurality of plastic bags from a continuous web of a layflat tubular plastic film, taken in conjunction with the accompanying drawings; in which.

DETAILED DESCRIPTION

Figure 1:
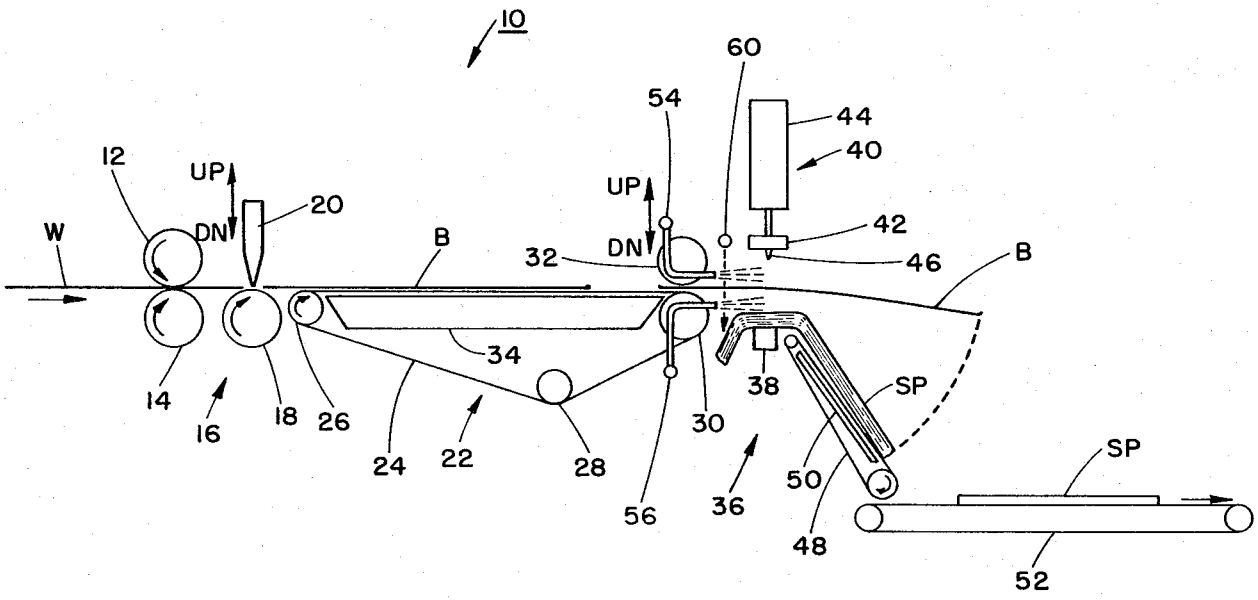
FIG. 1 schematically illustrates the basic arrangement of a plastic bag-forming and stacking apparatus pursuant to the invention.

Referring now in detail to the drawings, and particularly to the inventive apparatus schematically disclosed in FIG. 1, a continuous web W of a layflat tubular plastic film, which may have gusseted sidewall structure, is adapted to be conveyed between a pair of cooperating nip rolls 12 and 14 of the bag-forming section 16 of the bag-forming and stacking apparatus 10. The nip rolls 12 and 14 convey the film web W with an intermittent feed to a web-cutting and sealing station consisting of a rotatable seal roll 18 and a cooperating, vertically reciprocable cutting and seal bar 20 extending across the web W transverse of the direction of movement of the plastic film web W. The roll 18 and seal bar 20, at the downstroke of the latter, are adapted to sever the film web into segments of predetermined length to thereby form individual plastic bags, while concurrently forming hot seals at the leading and trailing edge of each such formed plastic bag.

The apparatus 10 further includes a cooling section 22 comprising a plurality of parallel, generally horizontally traveling perforated belts 24 having narrow spaces therebetween which are driven over guide rollers 26 and 28 and a nip roll 30 which is adapted to be engaged by a cooperating bag stop nip roll 32, as explained in further detail hereinbelow. Positioned beneath the upper run of the conveyor belts 24 is a vacuum box 34 which serves to concurrently retain a formed plastic bag B on the surface of the belt and to cool the hot leading edge and trailing edge seals extending transversely of the bags.

Located downstream of the outlet end of the conveyor belts 24, as represented by the cooperating bag stop nip rolls 30 and 32, is a bag stacking arrangement 36 of the inventive apparatus 10. The bag stacking arrangement 36 includes a vacuum box 38 located below and extending transversely across the path of movement of each other plastic bags which is being discharged from the perforate belts 24 between the cooperating rotatable nip rolls 30 and 32. Positioned above the vacuum box 38 is a stacker foot unit 40 which includes a vertically reciprocable plate 42 extending horizontally across and above the path of movement of the bag B, and which is adapted to be vertically reciprocated towards and away from the vacuum box 38 under the action of the suitable air cylinder 44. Depending from the bottom of the horizontal stacker foot plate 42 are a plurality of thin heated metal needles 46 adapted to pierce and seal together the stacked plastic bags B as is described in detail hereinbelow.

Located immediately downstream of the vacuum box 38 is a downwardly sloping, continuously traveling perforated conveyor belt 48 having a further vacuum box 50 arranged below the upper run of the belt.

Positioned below the lower discharge end of the conveyor belt 48 is a generally horizontally extending storage conveyor belt 52 which is adapted to be intermittently actuated.

Located adjacent to each of the nip rolls 30 and 32 are conduits 54 and 56 which are each adapted to direct a jet of air, respectively, above and below and in parallel with the longitudinal path of movement of each bag B as it is being discharged from the conveyor belts 24 to the bag stacking arrangement 36. The conduits 56 for the jets of air along the lower surfaces of each bag B extend between adjacent of the perforated belts 24 so as to direct the air jets through the spaces between the adjacent runs of the belts 24.

The operation of the inventive apparatus is now described in detail in conjunction with the various operative sequences of the bag-forming and stacking apparatus 10 setting forth one complete cycle as illustrated by FIGS. 2 through 12.

Figure 2:
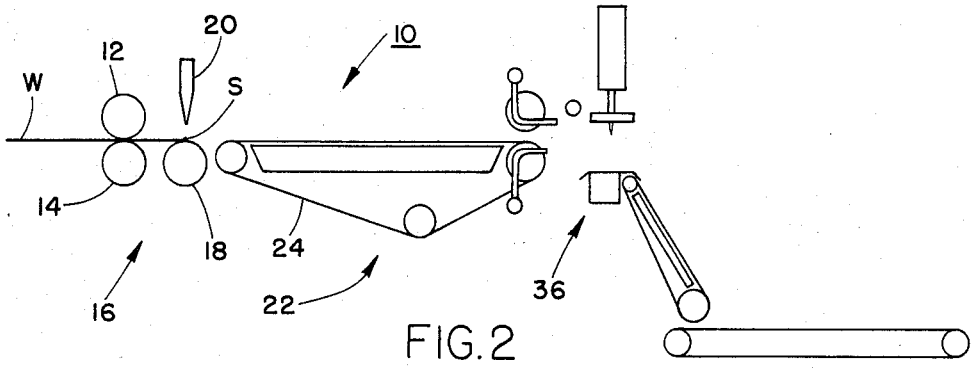
FIGS. 2 through 12 illustrate, in a manner analogous to the representation in FIG. 1, the inventive bag-forming and stacking apparatus in various operative stages of producing the stack of plastic bags.

At the beginning of a bag-forming and stacking cycle by the inventive apparatus, as illustrated in FIG. 2 of the drawings, the leading edge seal S of the layflat tubular plastic film W is supported on the rotatable seal roll 18, with the cutting and seal bar 20 being in a raised position and the rotatable nip rolls 12 and 14 being stationary.

Figure 3:
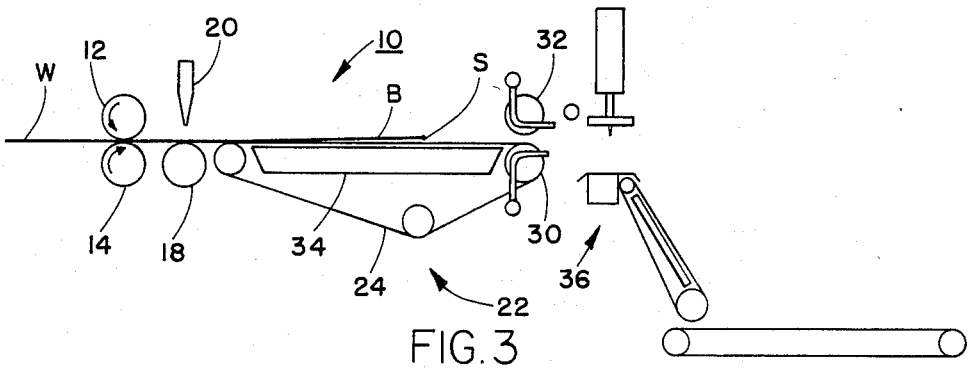
Figure 4:
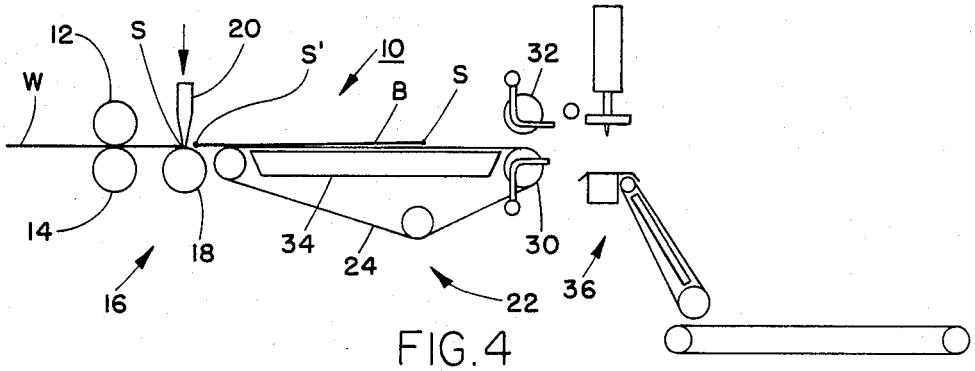

The nip rolls 12 and 14 are now set into rotation, as shown in FIG. 3, feeding out one bag length B of the film web W onto the perforated conveyor belt 24 so that the leading seal S of the plastic bag B is now positioned one bag-length past the cutting and seal bar 20. Concurrently therewith, the perforated conveyor belts 24 travel in the same direction a distance which is slightly less than the spacing between the cutting and seal bar 20 and the center of rotation of the bag stop nip roll 30, but somewhat longer than the length of the bag. Inasmuch as the perforated conveyor belts 24 travel a slightly longer distance than the length of the plastic bag, at the end of the indexed movement of the conveyor belts 24, the bag B is now in tension between the leading seal S and the nip rolls 12 and 14. This will ensure that the plastic bag B is securely and flatly positioned on the surfaces of the perforated conveyor belts 24, with the seal extending across the width of the bag being cooled through the aspirating air flow generated by the vacuum box 34.

At that point in time, the cutting and seal bar 20 is reciprocated downwardly so as to contact the cooperating seal roll 18, thereby severing one bag length B from the continuous layflat tubular plastic film W, and concurrently forming a trailing edge seal S' on the bag B which has been conducted onto the perforated conveyor belts 24 and a leading edge seal S across the leading edge of the web W which is being conducted between the nip rollers 12 and 14. This can be clearly ascertained from the positioning of the apparatus in FIG. 4 of the drawings.

Figure 5:
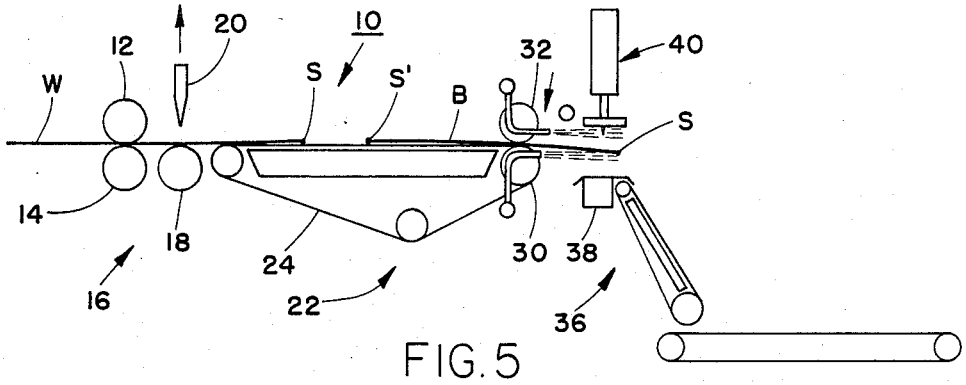

As can be ascertained from FIG. 5 of the drawings, during the subsequent indexing cycle of the intermittently forwardly fed continuous web of plastic material W through the nip rolls 12 and 14, wherein the cutting and sealing bar 20 is now in a raised position, a further section of the continuous web W is now conducted by the nip rolls 12 and 14 onto the indexing perforated conveyor belts 24. Concurrently, the preceding plastic bag B which is now located at the forward or discharge end of the conveyor belts 24, is now in a position to be transferred to the stacking arrangement 36 of the apparatus 10. Upon the leading seal S of the forward bag B being passed beneath the bag stop nip roll 32, which at this point is in a raised position relative to the cooperating nip roll 30, the nip roll 32 is moved downwardly into cooperation with nip roll 30 so as to clamp the plastic bag B against the perforated conveyor belts 24. The nip roll 32 is rotated at a speed which precisely conforms to the linear speed of the conveyor belts 24. It is necessary to maintain the nip roll 32 in an open position relative to the plastic bag B during passage of the leading seal S between the nip rolls 30 and 32 inasmuch as any pressure by the nip roll exerted against the leading seal S would tend to weaken or damage the relatively hot seal S. As the bag B is conducted off the discharge end of the conveyor belts 24 past nip rolls 30 and 32, the set of air fingers 54 and 56 which are located, respectively above and below the path of travel of bag B, will apply jets of air generally in parallel along the upper and lower surfaces of the plastic bag so as to control the movement of the plastic bag. This is necessary due to the inherently limp nature of the material of the thin plastic bag which, otherwise, would tend to flap down and possibly crumple.

Figure 6:
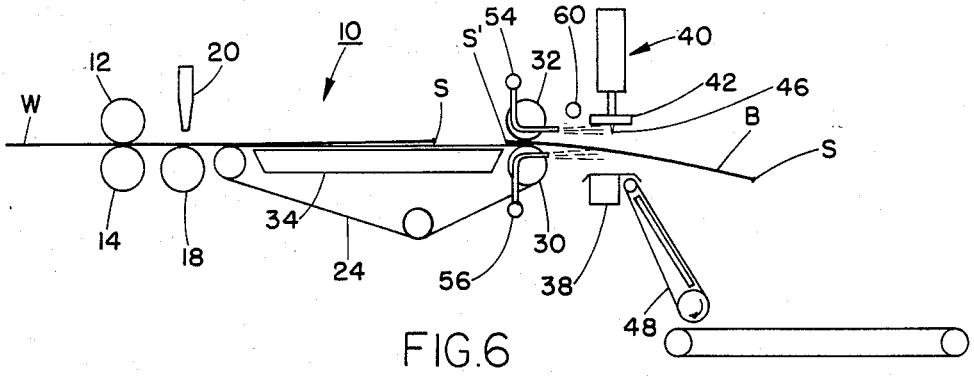

Referring now specifically to the apparatus as illustrated in FIG. 6 of the drawings, at the end of this point in the indexing cycle, as described hereinabove with regard to FIGS. 2 through 5, the nip rolls 12 and 14, the seal roll 18, the perforated conveyor belts 24 and the bag stop nip roll 32 are inactivated so as to be stationary, and the cutting and seal bar 20 is concurrently maintained in a raised position. This will positively stop the forward movement of the bag B which is presently located in the location of the stacking arrangement 36. In order to avoid any weakening of damaging of the trailing S' of the bag B at the end of this indexing cycle of movement, this seal S' is positioned slightly offset or upstream of the location where the nip roll 32 contacts the surface of the bag in cooperation with the perforated conveyor belts 24 and nip roll 30, to thereby avoid any possible damage to this still somewhat hot trailing seal S' on the plastic bag B.

Figure 7:
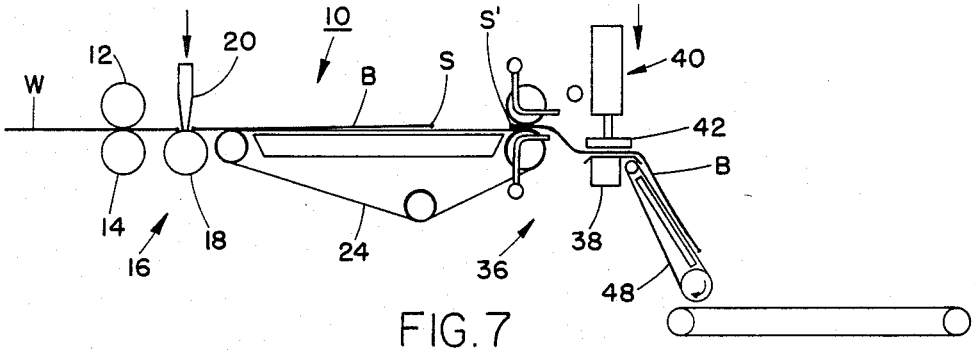
Figure 8:
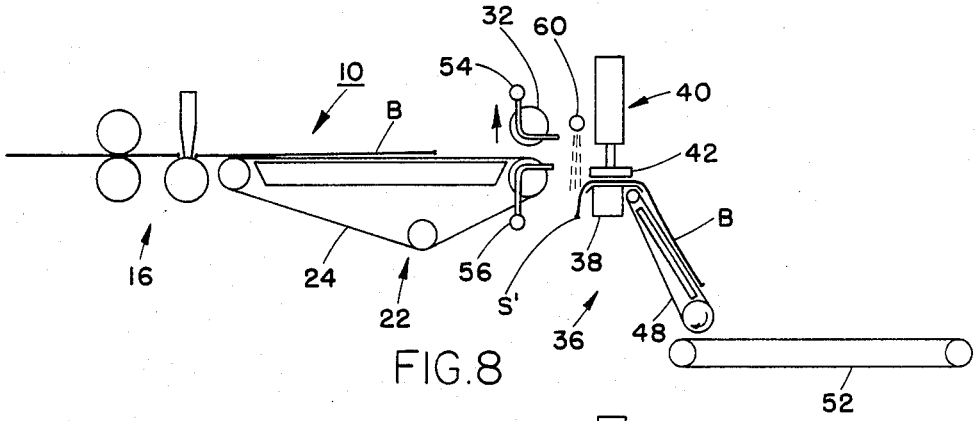

While the cutting and seal bar 20 effectuates the formation of the seals on the trailing edge of a subsequent bag B and the newly formed leading edge of the film web W, by being reciprocated downwardly towards the seal roll 18 into contact with web W, as illustrated in FIG. 7, there is activated the bag stacker mechanism 40. This is accomplished in that the air cylinder 44 is actuated so as to cause the stacker foot plate 42 to push the bag B down against the top surface of the vacuum box 38. At this point in the operation of the apparatus 10, the plastic bag B is maintained in position by the stacker foot plate 42 and the bag stop nip roll 32 pressing against the perforated conveyor belts 24. At the end of the downstroke of the stacker foot plate 42, as illustrated in FIG. 8 of the drawings, the bag stop nip roll 32 is raised, thereby releasing its clamping action on the bag B against the surface of the perforate conveyor belts 24, and a vertically downwardly direction air blast from an air duct 60 located adjacent the stacker mechanism 40 above the plastic bag B will cause the tail end portion with the seal S' of the plastic bag B to fold downwardly along the upstream side of the vacuum box 38. The forward or leading portion of the plastic bag B lies in surface contact with the upper run of the continually downward traveling endless conveyor belt 48, but is prevented from sliding along with the motion of the belt by the gripping action of the vacuum which is applied by the vacuum box 38, which is adequate to maintain the plastic bag B in a stationary position. Preferably, the surface of the conveyor belt 48 contacting the bag is of a low-friction material so as to prevent any injury to the surface of the plastic bag B caused by the rubbing frictional contact.

Figure 9:
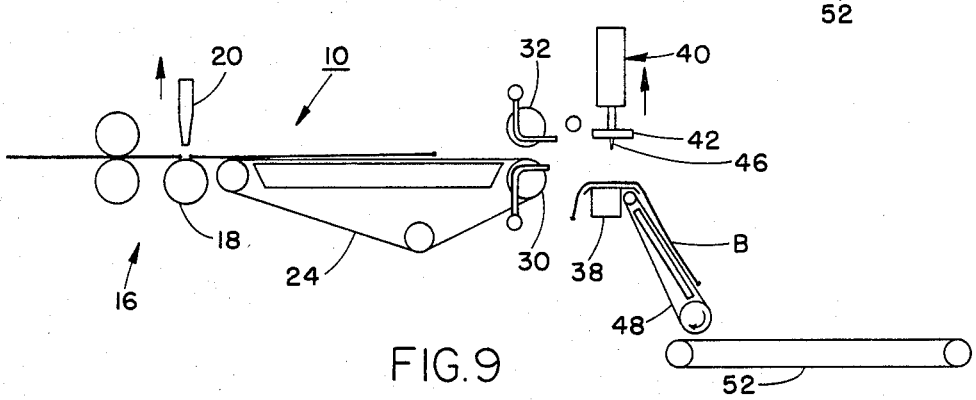

As shown in FIG. 9 of the drawings, the stacker foot plate 42 is then raised upwardly, disengaging from contact with the plastic bag B, with the latter being maintained in its relative position by the vacuum applied from the vacuum box 38.

Figure 10:
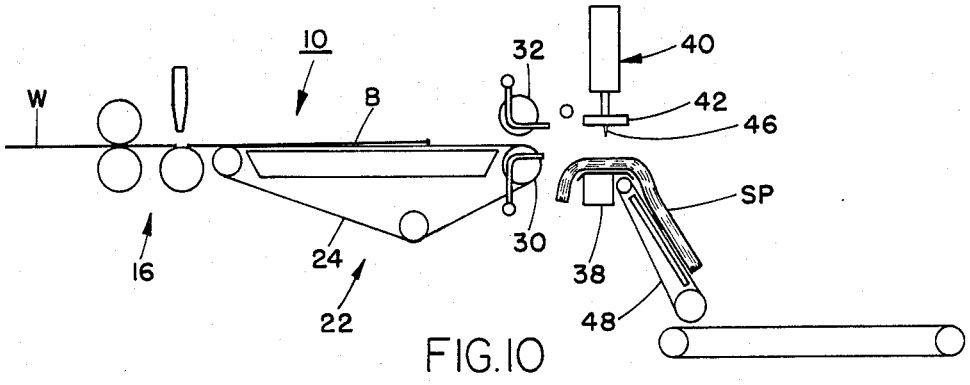
Figure 11:
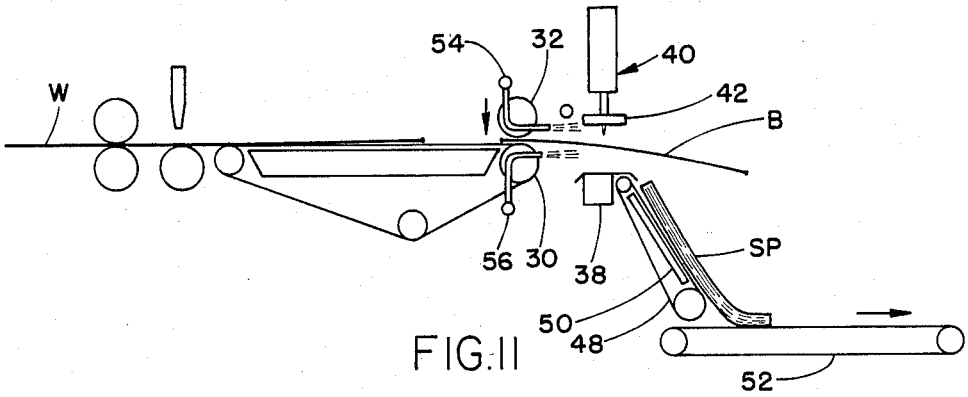

Referring now in particular to FIG. 10 of the drawings, the above-described sequence of operation of the apparatus 10, as elucidated with regard to FIGS. 2 through 9, is repeated for every plastic bag B which is brought into the stacked position SP. In essence, each successive plastic bag B brought into position beneath the stacker mechanism 40 is superimposed, in a manner as described hereinabove, upon a preceding plastic bag on the vacuum box 38. In order to prevent any sliding off of the subsequently superimposed plastic from the stack, and to provide a sealing action between the stacked bags, the stacker foot plate 42 is provided with a plurality of depending thin, heated needles 46 which are spaced across the width of the bags B. Consequently, each time a plastic bag B is conveyed into position above a preceding bag on the vacuum box 38, in a manner as described hereinbefore, upon the downstroke of the stacker foot plate 42, the heated needles 46 will penetrate through the stack of superimposed plastic bags B to thereby form point-like heat seals between the superimposed bags at the penetration locations. This will cause each of the superimposed plastic bags B of the stack to be sealed to every other bag. Subsequent to a predetermined number of bags being superimposed upon each other on the vacuum box 38, such number being determined by a suitable counter (not shown) on the controls of the apparatus, as for example 100 bags, the vacuum in the vacuum box 38 is deactivated and, concurrently, there is activated the vacuum of vacuum box 50 below the upper run of the continuously rotating perforated conveyor belt 48 on which there rests the forward portion of the plastic bag stack SP rests. Inasmuch as this vacuum will produce a clamping force between the upper surface of the continuously moving conveyor belt 48 and the contacting surface of the lowermost plastic bag of stack PS, the stack PS will be moved along with the conveyor belt 48. At this point in time; in essence, when the vacuum of the vacuum box 50 is activated, the bag stack storage conveyor belt 52 is placed into motion at a slightly higher linear speed than that of the conveyor belt 48. This will cause the stack of bags SP to be transferred to the bag storage conveyor belt 52, which is then automatically stopped once the full length of the bag stack is supported thereon.

Figure 12:
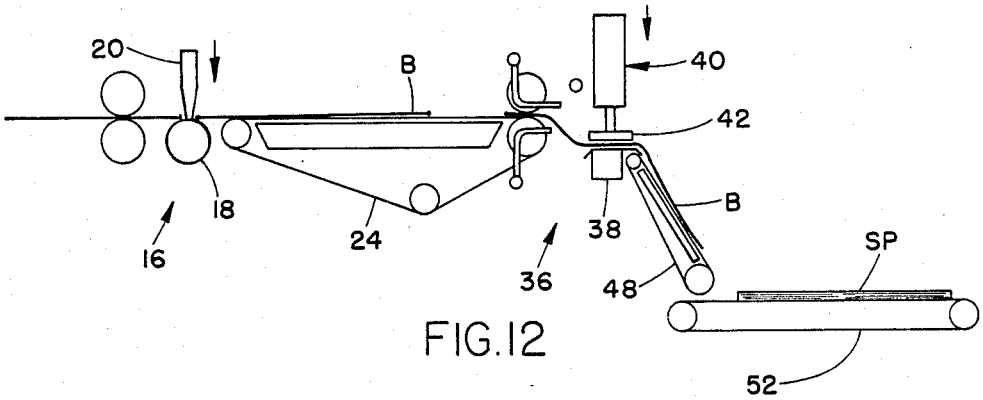

Thus, as is clearly illustrated in FIG. 12 of the drawings, once the trailing end of the stack SP passes beyond the top surface of the vacuum box 38, the vacuum therein is again turned on, and the vacuum in the vacuum box 50 deactivated. Thereafter, the first plastic bag of a subsequent stack which is to be formed is positioned by the stacker mechanism 40 on top of the vacuum box 38, and the entire cycle of forming a new plastic bag stack repeated as set forth hereinabove. During this interval, the previous stack of bags SP resting on the now stationary storage conveyor belt 52 may be removed manually or fully automatically for further processing or cutting into a finished bag configuration.

Figure 13:
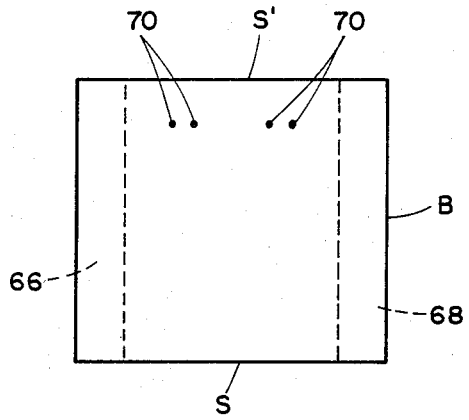
FIG. 13 illustrates a plan view of a gusseted plastic bag formed and stacked in accordance with the apparatus and method of the invention.
Figure 14:
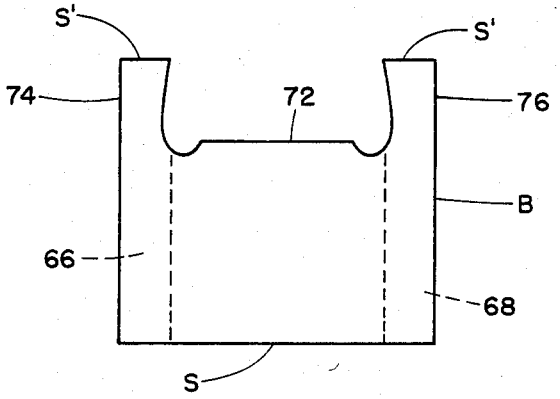
FIG. 14 illustrates a finished plastic bag adapted to be produced by the inventive apparatus and method.

As illustrated in an exemplary manner in FIG. 13 of the drawings, the plastic bag B may be of a gusseted construction having tucked-in side gussets 66 and 68 extending along the length of the web W in a manner well known in the art prior to being conducted between the nip rolls 12 and 14. As illustrated, the plastic bag B has a plurality of small apertures 70 formed therethrough across the bag, these apertures having been formed by the heated needles 46 on the bottom of the stacker foot plate 42 during the sealing together of the stack bags. The bag B, as shown in FIG. 14, which may be one of a large number of bags stacked and sealed together by means of the sealing apertures 70, which then be cut by means of a suitable cutting apparatus (not shown) along line 72 so to form a gusseted shopping bag, as commonly used in supermarkets, having cut out handle portions 74 and 76, and an inlet opening for the bag.

From the foregoing there may be clearly ascertained that the present invention provides for an intermittently operating apparatus and method for forming and stacking plastic bags in a rapid and automatic sequence which will completely eliminate any interruption between the cycles of producing successive stacks of plastic bags.

Modifications of the inventive apparatus readily suggest themselves to one skilled in the art. Thus, for bags having a heavy seal bead at each end, which could develop into "sticky end seals" while being stacked, for example, at the trailing end of the bag, the cooling section provided for by the perforated conveyor belt 24 and the vacuum box 34 may be made lengthier so as to allow for extra dwelling time, one cycle or more, for cooling the hot seal prior to conveying the bag into the stacking arrangement of the apparatus. Thus, the cooling section represented by the perforated conveyor belts 24 and the vacuum box 34 may be, if desired, of a length of at least two or more plastic bag lengths.

For instance, when it is desired to provide for the additional cooling of the bags which are deposited on the perforated conveyor belts 24, for example, when the belts have a length of about two bag lengths, the belts 24 may be indexed forward twice for each web feeding cycle of the bag-forming section 16. The same ratio is effective when the cooling section has the length of three bags; in essence, the belts 24 are indexed three times for each cycle of the bag-forming section 16 as represented by the cutting and sealing bar 20 and cooperating seal roll 18.

Furthermore, although the apparatus has been described with regard to forming a single line of stacked bags, it is possible to contemplate the provision of two or even more concurrently operating production lanes in a side-by-side relationship by simply widening the apparatus construction, thereby extensively increasing or multiplying the production output of the apparatus. Furthermore, the apparatus and the stacking mechanism allows for the production of plastic bags having different lengths without requiring any physical or mechanical modifications of the apparatus by merely changing the length of web being fed out onto the conveyor belts 24, thereby enhancing the versatility of the apparatus.

While there has been shown and described what are considered to be preferred embodiments of the invention, it should be understood that variations in form and detail could readily be made without departing from the spirit of the invention. It is therefore intended that the invention be not limited to the exact form and detail shown herein and described, nor to anything other than the whole of the invention as hereinafter claimed.

What is claimed is:

1. An apparatus for sequentially forming and stacking a plurality of plastic bags severed from a continuous web of a layflat tubular plastic film material, comprising:

(a) means for intermittently feeding predetermined lengths of said plastic film; heated means for severing said film into said lengths and concurrently forming transverse hot seals across said severed lengths to provide sealed plastic bags;

(b) means receiving said sealed plastic bags from said severing and sealing means, said receiving means comprising intermittently traveling perforate conveyor belt means supporting said sealed bags, and vacuum generating means below said belt means for retaining said sealed bags on said belt means and concurrently cooling said hot seals;

(c) bag stacker means for stacking successive plastic bags discharged from said perforate conveyor belt means and adhering said stacked bags to each other;

(d) and conveying means for transporting said stacked and adherent plastic bags from said bag stacker means.

2. Apparatus as claimed in claim 1, said intermittent feeding means for said web comprising a pair of cooperating rotatable nip rolls, and said severing and sealing means including a rotatable seal roll supporting said web downstream of said nip rolls, and a vertically reciprocable heated sealer bar cooperating with said seal roll to sever said web and concurrently form said bag seals.

3. Apparatus as claimed in claim 1 or 2, said perforated conveyor belt means being driven in synchronism with the rotation of said nip rolls at a slightly higher linear speed so as to impart tension to the plastic bag positioned thereon.

4. Apparatus as claimed in claim 1 or 2, said bag stacker means comprising a vacuum box positioned downstream of the discharge end of said conveyor belt means; a vertically reciprocable stacker foot spaced above said vacuum box to allow passage of said plastic bags therebetween, means for reciprocating said stacker foot to position a bag on said vacuum box, said vacuum box being supplied with a vacuum to maintain said bag on said vacuum box, means for positioning the trailing edge of the bag at the upstream side of the vacuum box, and means at the downstream side of the vacuum box for supporting the leading portion of said plastic bag.

5. Apparatus as claimed in claim 4, said perforated conveyor belt means sequentially conducting a plurality of said plastic bags to said bag stacker means, said stacker foot including a plurality of depending heated pins adapted to penetrate the superimposed plastic bags and forming point seals between said bags.

6. Apparatus as claimed in claim 4, comprising means for conveying jets of air along the surfaces of said bags to controllably guide each said bag between the stacker foot and the vacuum box.

7. Apparatus as claimed in claim 4, said trailing edge positioning means comprising an air jet directed vertically downwardly against the trailing end surface of said bag.

8. Apparatus as claimed in claim 4, comprising an air cylinder for reciprocating said stacker foot.

9. Apparatus as claimed in claim 4, said means for supporting the leading portion of said bags comprising a continuously moving downwardly sloping perforate conveyor belt in normally fictional rubbing contact with the bottom surface of the lowermost bag on said vacuum box.

10. Apparatus as claimed in claim 9, comprising vacuum generating means located below said sloping conveyor belt, said vacuum genertating means being activated concurrently with deactivation of the vacuum box of said bag stacker means upon stacking of a predetermined number of said plastic bags so as to cause said belt to convey said stack of bags from said bag stacker means.

11. Apparatus as claimed in claim 10, comprising an intermittently driven storage conveyor belt adapted to receive said stack of plastic bags from said sloping conveyor belt.

12. An apparatus for sequentially forming and stacking a plurality of plastic bags severed from a continuous web of a layflat tubular plastic film material, comprising:

(a) means for intermittently feeding predetermined lengths of said plastic film; heated means for severing said film into said lengths and concurrently forming transverse hot seals across said severed lengths to provide sealed plastic bags;

(b) means for receiving said sealed plastic bags from said severing and sealing means, said receiving means comprising intermittently traveling perforate conveyor belt means supporting said sealed bags, and vacuum generating means below said belt means for retaining said sealed bags on said belt means and concurrently cooling said hot seals;

(c) bag stacker means for stacking successive plastic bags discharged from said perforate conveyor belt means and adhering said stacked bags to each other;

(d) conveying means for transporting said stacked and adherent plastic bags from said bag stacker means; and (e) cooperating bag stop nip rolls at the discharge end of said belt means for engaging the trailing end portion of plastic bag when said belt means is stationary.

13. An apparatus for sequentially forming and stacking a plurality of plastic bags severed from a continuous web of a layflat tubular plastic film material, comprising:

(a) means for intermittently feeding predetermined lengths of said plastic film; heated means for severing said film into said lengths and concurrently forming transverse hot seals across said severed lengths to provide sealed plastic bags;

(b) means for receiving said sealed plastic bags from said severing and sealing means, said receiving means comprising (i) intermittently traveling perforate conveyor belt means supporting said sealed bags and having a length corresponding to a plurality of intermittently fed plastic film lengths, said conveyor belt means being indexed forward a plurality of cycles for each intermittent feed cycle of said plastic film feeding means, and (ii) vacuum generating means below said belt means for retaining said sealing bags on said belt means and concurrently cooling said hot seals;

(c) bag stacker means for stacking successive plastic bags discharged from said perforate conveyor belt means and adhering said stacked bags to each other; and (d) conveying means for transporting said stacked and adherent plastic bags from said bag stacker means.

14. A method of sequentially forming and stacking a plurality of plastic bags from a continuous web of a layflat tubular plastic film, comprising:

(a) intermittently advancing said web of plastic film; sequentially severing predetermined lengths from said web and concurrently forming transverse end seals so as to form sealed plastic bags;

(b) conveying said plastic bags through a cooling zone for cooling said seals;

(c) positioning each bag in successive superposition in a stacking arrangement, and sealing said bags together at predetermined locations to form an interconnected stack of plastic bags.

15. Method as claimed in claim 14, comprising cooling said seals through the application of a vacuum to perforated conveyor belt means supporting said bags.

16. Method as claimed in claim 14 or 15, comprising interconnecting said stacked bags by penetration with heated needles forming point seals.

17. Method as claimed in claim 14, comprising conveying said stacked bags from said stacking arrangement onto a storage conveyor.

18. A method of sequentially forming and stacking a plurality of plastic bags from a continuous web of a layflat tubular plastic film, comprising:

(a) intermittently advancing said web of plastic film, sequentially severing predetermine lengths from said web and concurrently forming transverse end seals so as to form sealed plastic bags;

(b) conveying said plastic bags through a cooling zone for cooling said seals; and (c) positioning each bag in successive superposition in a stacking arrangement on a vacuum box through the action of a reciprocating stacker foot, and sealing and interconnecting said stacked bags together at predetermined locations by penetration with heated needles depending from said stacker foot and forming point seals to form an interconnected stack of plastic bags.

19. A method of sequentially forming and stacking a plurality of plastic bags from a continuous web of a layflat tubular plastic film, comprising:

(a) intermittently advancing said web of plastic film; sequentially severing predetermined lengths from said web and concurrently forming transverse end seals so as to form sealed plastic bags;

(b) conveying said plastic bags through a cooling zone for cooling said seals;

(c) positioning each bag in successive superposition in a stacking arrangement, and sealing said bags together at predetermined locations to form an interconnected stack of plastic bags; and (d) applying directed air jets against the surfaces of said plastic bags for controlled positioning in said stacking arrangement.

20. A method of sequentially forming and stacking a plurality of plastic bags from a continuous web of a layflat tubular plastic film, comprising:

(a) intermittently advancing said web of plastic film; sequentially severing predetermined lengths from said web and concurrently forming transverse end seals so as to form sealed plastic bags;

(b) conveying said plastic bags through a cooling zone for cooling said seals;

(c) positioning each bag in successive superposition in a stacking arrangment, and sealing said bags together at predetermined locations to form an interconnected stack of plastic bags;

(d) cooling said seals through the application of a vacuum to perforated conveyor belt means supporting said bags; and (e) indexing said perforated conveyor belt means for cooling said seal a plurality of indexing cycles relative to each indexing cycle for advancing and severing said plastic film web.

* * * * *